United States Patent [19]

de Jong et al.

[11] Patent Number: 4,715,973

[45] Date of Patent: Dec. 29, 1987

[54] LUBRICATING OIL COMPOSITIONS

[75] Inventors: Feike de Jong; Jacob Vermeule, both of Amsterdam, Netherlands

[73] Assignee: Shell Oil Company, Houston, Tex.

[21] Appl. No.: 835,580

[22] Filed: Jan. 30, 1986

[30] Foreign Application Priority Data

Mar. 15, 1985 [NL] Netherlands ..... 8500753

[51] Int. Cl.[4] ..... C10M 141/02

[52] U.S. Cl. ..... 252/40.5; 252/42

[58] Field of Search ..... 252/40.5, 42

[56] References Cited

U.S. PATENT DOCUMENTS

| | | | |
|---|---|---|---|
| 2,123,641 | 7/1938 | Weizevich et al. | 87/9 |
| 2,163,622 | 6/1939 | Neely et al. | 252/40.5 |
| 2,607,735 | 8/1952 | Sproule et al. | 252/40.5 |
| 2,769,781 | 11/1956 | Butcosk | 252/40.5 |
| 2,791,559 | 5/1957 | Cyphers et al. | 252/40.5 |
| 2,877,181 | 3/1959 | Dilworth | 252/40.5 |
| 2,895,914 | 7/1959 | Kern et al. | 252/40.5 |
| 2,969,325 | 1/1961 | Roach | 252/42 |
| 3,083,163 | 3/1963 | Perras | 252/40.5 |
| 3,429,820 | 2/1969 | Lyons | 252/78 |
| 3,455,825 | 7/1969 | Lawrence et al. | 252/40.5 |
| 3,585,138 | 6/1971 | Boehringer et al. | 252/40.5 |
| 3,909,425 | 9/1975 | Crawford | 252/32.7 |
| 4,428,850 | 1/1984 | Zoleski | 252/42.7 |

FOREIGN PATENT DOCUMENTS

| | | |
|---|---|---|
| 721285 | 1/1955 | United Kingdom . |
| 1057233 | 10/1964 | United Kingdom . |
| 2006246A | 5/1979 | United Kingdom . |

*Primary Examiner*—William R. Dixon, Jr.
*Assistant Examiner*—Cynthia A. Prezlock

[57] ABSTRACT

Lubricating oil compositions, prepared by the addition of at least one basic salts comprising polyvalent metal salt of naphthenic acids to at least one hydrocarbon lubricating oil, are stabilized above 140° C. by the addition of at least one polyester, or salt of said polyester. The polyesters lead to marked improvement in stability even when used in low concentrations.

28 Claims, No Drawings

LUBRICATING OIL COMPOSITIONS

FIELD OF THE INVENTION

The invention relates to lubricating oil compositions prepared by a process which comprises adding one or more polyesters or salts of said polyesters to a mixture of one or more lubricating oils and one or more basic salts.

BACKGROUND OF THE INVENTION

During the combustion of fuels in combustion engines acidic combustion products may find their way into the motor oil and thus give rise to corrosion of the engine. In order to neutralize the acidic combustion products, basic salts comprising polyvalent metal salts of naphthenic acids can be dissolved in the motor oil. The stability of solutions of said basic salts in hydrocarbon lubricating oils has been found to be unsatisfactory, and the stability of these solutions becomes even poorer as they contain larger quantities of the basic salts and as the salts have a higher basicity. It has now been found that the stability above 140° C. of said solutions can be considerably improved by the addition of certain polyesters or polyester salts.

Polyesters have been used in a variety of ways in other organic compositions. British Pat. No. GB 2,006,246 discloses polyesters as dispersion agents for pigments in organic liquids. Polyesters were used as anti-foam and anti-squeal agents in U.S. Pat. Nos. 4,428,850, 3,909,425, and 3,429,820. Polyesters were further used to increase the viscosity and yield of sodium base greases in U.S. Pat. No. 2,969,325, and to harden and stabilize anhydrous calcium fatty acid greases at room temperatures in U.S. Pat. No. 2,877,181. However, none of the before mentioned patents discloses the process of the present invention, whereby polyesters and their salts are used to produce concentrated and dilute hydrocarbon lubricating oil compositions of basic salts that are stabilized above 140° C. by the addition of at least one polyester or polyester salt.

BRIEF DESCRIPTION OF THE INVENTION

The patent application therefore relates to lubricating oil compositions stable above 140° C. prepared by the process steps of: continually stirring above 60° C. a lubricating oil mixture comprising at least one hydrocarbon lubricating oil with at least one basic salt comprising polyvalent metal salts of naphthenic acids, and thereafter admixing at least one compound selected from the group consisting of (1) polyesters, salts of said polyesters, and mixtures thereof, said polyesters being derived from at least one hydroxycarboxylic acid of the general formula HO—X—COOH, wherein X represents a bivalent saturated or unsaturated aliphatic radical containing at least 8 carbon atoms with at least 4 carbon atoms situated between the hydroxyl group and the carboxyl group, and (2) polyesters, salts of said polyesters, and mixtures thereof, said polyesters being derived from a mixture of at least one hydroxycarboxylic acid of the general formula HO—X—COOH and at least one carboxylic acid containing no hydroxyl groups to form said stable composition of matter.

DETAILED DESCRIPTION OF THE INVENTION

The hydrocarbon lubricating oils present in the compositions of the invention may be mineral or synthetic lubricating oils. The compositions may also contain mixtures of hydrocarbon lubricating oils. An example of such a mixture is a mixture of mineral lubricating oils, for instance a mixture of a distillate lubricating oil and a residual lubricating oil. Another example of such a mixture is a mixture of a mineral lubricating oil and a synthetic hydrocarbon lubricating oil. Examples of suitable synthetic hydrocarbon lubricating oils are polyolefins, such as polyisobutylenes. Preferably the lubricating oil component of the compositions according to the invention is a mineral lubricating oil or a mixture of mineral lubricating oils. The viscosity of the lubricating oils present in the lubricating oil compositions may vary within wide ranges.

The basic salts, comprising polyvalent metal salts of naphthenic acids, occurring in the composition according to the invention preferably are salts of metals from Group II of the Periodic Table of Elements whose atomic number is at least 12 and at most 56. Most specific preference is given to salts of the metals barium, calcium and magnesium, special preference being given to calcium salts. In regard to the naphthenic acids from which the basic salts are derived, salts derived from naphthenic acids of an average molecular weight between 150 and 750 and salts having a basicity between 100 and 1000, in particular between 250 and 1000, are preferred. The basicity of the basic salts is calculated with the aid of the following formula:

$$\text{basicity in } \% = (M/E - 1) \times 100,$$

wherein M represents the number of equivalents of metal and E the number of equivalents of carboxylic acid per unit of weight of basic salt.

The polyesters occurring in the lubricating oil compositions according to the invention are derived either from certain hydroxycarboxylic acids, or from a mixture of one or more of such hydroxycarboxylic acids and one or more carboxylic acids containing no hydroxyl groups. Salts of the polyesters are also very suitable for the present purpose. It is preferred to use polyesters which have been derived from hydroxycarboxylic acids in which the X in the general formula HO—X—COOH represents a bivalent saturated or unsaturated aliphatic radical which contains at least 8 carbon atoms and in particular contains 12 to 20 carbon atoms. Further, preference is given to hydroxycarboxylic acids wherein 8 to 14 carbon atoms are situated between the hydroxyl group and the carboxyl group. The hydroxyl group occurring in the hydroxycarboxylic acid is preferably a secondary hydroxyl group. Examples of suitable hydroxycarboxylic acids from which the polyesters can be derived are 9-hydroxystearic acid, 10-hydroxystearic acid, 12-hydroxystearic acid and ricinolic acid. If the polyesters are derived from a mixture of one or more hydroxycarboxylic acids and one or more carboxylic acids containing no hydroxyl groups, it is preferred that the latter category of carboxylic acids be selected from the group of saturated or unsaturated carboxylic acids with 8 to 20 carbon atoms, such as lauric acid, palmitic acid, stearic acid and oleic acid. The polyesters which are used in the lubricating oil compositions according to the invention can be prepared in a simple manner by heating one or more of the hydroxycarboxylic acids, optionally together with one or more carboxylic acids containing no hydroxyl groups, optionally in the presence of a solvent and/or an esterification catalyst, preferably at a temperature between 100° and 200° C. Examples of suitable mixtures of carboxylic acids which may be used as starting material in the preparation of the polyesters are mixtures of 9-hydroxystearic acid and 10-hydroxystearic acid, mixtures of 12-hydroxystearic acid and stearic acid, mixtures of 12-hydroxystearic acid with palmitic acid and stearic acid, and mixtures of ricinolic acid and oleic acid. In the lubricating oil compositions preference is given to the use of polyesters which are derived from 12-hydroxystearic acid or from a mixture of carboxylic acids substantially consisting of 12-hydroxycarboxylic acids. As for the preferred average molecular weight of the polyesters present in the lubricating oil compositions, preference is given to polyesters having an average molecular weight of 500–4000 and in particular of 1000–2500.

Instead of or in addition to the polyesters the lubricating oil compositions can also include salts of the polyesters. These salts may be metal salts, such as alkali metal salts or alkaline earth metal salts, and also reaction products of the polyesters with bases such as ammonia and amines. If the lubricating-oil compositions include a salt of a polyester, this salt preferably is an alkaline earth metal salt and in particular a calcium salt.

The quantities in which the basic salts and the polyesters occur in the lubricating oil compositions according to the invention may vary within very wide ranges. One of the reasons is that, in addition to comprising lubricating oil compositions in which the additives are present in concentrations that are usual in ready motor oils, the present invention also relates to additive concentrates in lubricating oil. It is known that for storage and transport of lubricating oil additives the usual procedure is to use additive concentrates in lubricating oil which can be diluted with lubricating oil to prepare motor oils. Since the stability of solutions of the basic salts in hydrocarbon lubricating oils becomes lower as these solutions contain higher quantities of the basic salts, as stated before, and since concentrates in lubricating oil may contain up to about 90%w of the basic salts, the present invention is of particular importance for the stabilization of these concentrates. Lubricating oil compositions in which the basic salts are present in such concentrations as are usual in ready motor oils, such as lubricating oil compositions containing as little as about 0.5%w basic salt and lubricating oil compositions containing up to about 35%w basic salt, are eligible for use as motor oil.

The polyesters which are present in the lubricating oil compositions according to the invention, even when used in low concentrations, calculated on the amount of basic salts, lead to a marked improvement in stability, and their stability-improving effect extends over a very wide range of concentrations. It has further been found that, in addition to their stabilizing effect, the present polyesters also have a cleansing effect which renders them capable of suppressing fouling of the engine. On account of the latter property, it may be desirable to take up in the lubricating oil compositions a considerably higher quantity of polyester than would be used exclusively for reasons of stability improvement. In general, the lubricating oil compositions according to the invention will contain not less than 0.01%w and not more than 45%w of the polyesters.

In addition to the basic salts and polyesters the lubricating oil compositions may also contain other additives such as antioxidants, corrosion-inhibiting additives, antirust additives, antifoam additives, antiwear additives, high-pressure additives and viscosity-improving and/or viscosity-index-improving additives.

The present lubricating-oil compositions can be prepared in a simple manner by combining one or more hydrocarbon lubricating oils, one or more of the basic salts, one or more of the polyesters or salts of said polyesters, and optionally one or more other additives. If the lubricating-oil compositions according to the invention are available in the form of concentrates, these can be used to prepare lubricating-oil compositions which are suitable for use as motor-oil by diluting them with one or more hydrocarbon lubricating oils and optionally adding one or more other additives.

The invention is now illustrated with the aid of the following example.

EXAMPLE

In a number of experiments the influence of the addition of polyesters was determined on the stability of solutions of basic salts of naphthenic acids in a hydrocarbon lubricating oil. The hydrocarbon lubricating oil used was a mixture of a mineral lubricating oil with a viscosity of 160 seconds Redwood I at 60° C. and a mineral lubricating oil with a viscosity of 650 seconds Redwood I at 60° C. in a 3.25:1 volume ratio. In the experiments the following basic salts and polyesters were used.

Salt 1: Calcium naphthenate having a 760% basicity and a calcium content of 7.09%w.

Salt 2: Calcium naphthenate having a 740% basicity and a calcium content of 8.49%w.

Salt 3: Calcium naphthenate of a 730% basicity and a calcium content of 8.43%w.

Polyester A: Polyester of 12-hydroxystearic acid having an average molecular weight of about 1800.

Polyester B: Calcium salt of polyester A.

Polyester C: Polyester of 12-hydroxystearic acid having an average molecular weight of about 3500.

A number of lubricating oil compositions were prepared by dissolving in the lubricating oil mixture while stirring at 60° C. enough of each one of salts 1–3 to yield compositions having a TBN value of 70 mg KOH/g, as determined by ASTM D2896/IP 276.

In order to determine the stability of the lubricating oil compositions, a number of calibrated centrifugal tubes, as described in ASTM D96, were filled with 100 ml of the prepared lubricating-oil compositions with varying quantities of the polyesters A–C added. There are also a number of cases in which no polyester was added to the lubricating-oil compositions, or in which 12-hydroxystearic acid was added instead of polyester. The centrifugal tubes were placed in an oven at 140° C. for a period of 7 days. After 2 days and after 7 days the quantities of solid material that had been deposited, expressed as %v, were read from the tube gauges.

The results of these experiments are given in Table 1.

Of the lubricating oil compositions named in the table the compositions 5–18, 20–22 and 24–26 are compositions according to the invention. Compositions 1–4, 19 and 23 fall outside the scope of the invention. They have been included in the patent application for comparison.

The favorable influence of the present polyesters A–C and salts thereof on the stability of the solutions of the present basic salts in hydrocarbon lubricating oils becomes quite evident when a comparison is made between the stabilities of the following compositions;

compositions 5–18 with composition 1; compositions 20–22 with composition 19; and compositions 24–26 with composition 23.

The results given in Table 1 moreover show that addition of 12-hydroxystearic acid (compositions 2–4) instead of a polyester produces no significant improvement of the stability.

TABLE 1

| Lubricating-oil composition No. | Basic salt No. | Added Substance | Concentration of Added substance, % w | Quantity of deposited solid material, % v after 2 days | after 7 days |
|---|---|---|---|---|---|
| 1 | 1 | — | — | 23 | 15 |
| 2 | 1 | 12-hydroxy-stearic acid | 0.2 | 18 | 14 |
| 3 | 1 | 12-hydroxy-stearic acid | 0.4 | 17 | 12 |
| 4 | 1 | 12-hydroxy-stearic acid | 0.6 | 18 | 13 |
| 5 | 1 | Polyester A | 0.1 | 0.5 | 2 |
| 6 | 1 | " | 0.2 | 0.0 | <0.05 |
| 7 | 1 | " | 0.4 | 0.0 | 0.0 |
| 8 | 1 | " | 0.6 | 0.0 | 0.0 |
| 9 | 1 | " | 0.8 | <0.05 | 0.05 |
| 10 | 1 | " | 1.2 | 0.0 | 0.0 |
| 11 | 1 | Polyester B | 0.2 | 0.08 | 0.08 |
| 12 | 1 | " | 0.4 | 0.0 | <0.05 |
| 13 | 1 | " | 0.6 | 0.0 | <0.05 |
| 14 | 1 | Polyester C | 0.2 | 1.0 | 1.0 |
| 15 | 1 | " | 0.4 | <0.05 | 0.05 |
| 16 | 1 | " | 0.6 | <0.05 | 0.05 |
| 17 | 1 | " | 0.8 | <0.05 | 0.05 |
| 18 | 1 | " | 1.0 | <0.05 | <0.05 |
| 19 | 3 | — | — | 23 | 17 |
| 20 | 2 | Polyester A | 0.2 | <0.05 | <0.05 |
| 21 | 2 | " | 0.4 | 0.0 | <0.05 |
| 22 | 2 | " | 0.6 | 0.0 | 0.0 |
| 23 | 3 | — | — | 20 | 14 |
| 24 | 3 | Polyester A | 0.2 | <0.05 | 0.6 |
| 25 | 3 | " | 0.4 | 0.0 | <0.05 |
| 26 | 3 | " | 0.6 | 0.0 | <0.05 |

What is claimed is:

1. A composition of matter stable above 140° C. prepared by the process steps of: stirring a lubricating oil mixture comprising at least one hydrocarbon lubricating oil with at least one basic polyvalent metal salt of a naphthenic acid having a basicity of between about 100 and about 1000%, and admixing at least one compound selected from the group consisting of a first polyester, a salt of said first polyester, and mixtures thereof, said first polyester being derived from at least one hydroxycarboxylic acid of the general formula HO—X—COOH, wherein X represents a bivalent saturated or unsaturated aliphatic radical containing at least 8 carbon atoms with at least 4 carbon atoms situated between the hydroxyl group and the carboxyl group, and a second polyester, a salt of said second polyester, and mixtures thereof, said second polyester being derived from a mixture of at least one hydroxycarboxylic acid of the general formula HO—X—COOH and at least one carboxylic acid containing no hydroxyl groups to form said stable composition of matter.

2. The composition of claim 1 wherein the hydrocarbon lubricating oil comprises at least one mineral lubricating oil.

3. The composition of claim 1 wherein the basic salt comprises at least one salt selected from the group consisting of salts of polyvalent metals from Group II of the Periodic Table of Elements whose atomic number is between about 12 and about 56.

4. The composition of claim 1 wherein the basic sait is derived from a naphthenic acid having an average molecular weight between about 150 and about 750.

5. The composition of claim 1 wherein the polyesters and the salts of said polyesters are derived from hydroxycarboxylic acids in which the radical X in the general formula HO—X—COOH contains about 10 to about 20 carbon atoms.

6. The composition of claim 1 wherein the polyesters and salts of said polyesters are derived from hydroxycarboxylic acids in which about 8 to about 14 carbon atoms are situated between the hydroxyl group and the carboxyl group.

7. The composition of claim 1 wherein the polyesters and salts of said polyesters are derived from hydroxycarboxylic acids containing a secondary hydroxyl group.

8. The composition of claim 1 wherein the polyesters and salts of said polyesters are derived from a mixture of at least one hydroxycarboxylic acid and at least one carboxylic acid having about 8 to about 20 carbon atoms, having no hydroxyl groups, and selected from the group consisting of saturated and unsaturated carboxylic acids.

9. The composition of claim 1 wherein the polyesters and salts of said polyesters have an average molecular weight of about 500 to about 4000.

10. The composition of claim 1 wherein the amount of basic salt is between about 0.5 and about 90%w and the amount of polyester and salt of said polyester is between about 0.01 and about 45%w, based on the weight of the composition.

11. A process for the preparation of a composition of matter stable above 140° C. which comprises stirring a lubricating oil mixture comprising at least one hydrocarbon lubricating oil with at least one basic polyvalent metal salt of a naphthenic acid having a basicity of between about 100 and about 1000%, and admixing at least one compound selected from the group consisting of a first polyester, a salt of said first polyester, and mixtures thereof, said first polyester being derived from at least one hydroxycarboxylic acid of the general formula HO—X—COOH, wherein X represents a bivalent saturated or unsaturated aliphatic radical containing at least 8 carbon atoms with at least 4 carbon atoms situated between the hydroxyl group and the carboxyl group, and a second polyester, a salt of said second polyester, and mixtures thereof, said second polyester being derived from a mixture of at least one hydroxycarboxylic acid of the general formula HO—X—COOH and at least one carboxylic acid containing no hydroxyl groups to form said stable composition of matter.

12. The process of claim 11 wherein the hydrocarbon lubricating oil comprises at least one mineral lubricating oil.

13. The process of claim 11 wherein the basic salt comprises at least one salt selected from the group consisting of salts of polyvalent metals from Group II of the Periodic Table of Elements whose atomic number is between about 12 and about 56.

14. The process of claim 11 wherein the basic salt comrpises at least one salt selected from the group consisting of salts of barium, calcium or magnesium.

15. The process of claim 11 wherein the basic salt comprises at least one calcium salt.

16. The process of claim 11 wherein the basic salt is derived from a naphthenic acid having an average molecular weight between about 150 and about 750.

17. The process of claim 11 wherein the basic salts have a basicity between about 250 and about 1000.

18. The process of claim 11 wherein the polyesters and the salts of said polyesters are derived from hydroxycarboxylic acids in which the radical X in the general formula HO—X—COOH contains about 10 to about 20 carbon atoms.

19. The process of claim 11 wherein the polyesters and salts of said polyesters are derived from hydroxycarboxylic acids in which about 8 to about 14 carbon atoms are situated between the hydroxyl group and the carboxyl group.

20. The process of claim 11 wherein the polyesters and salts of said polyesters are derived from hydroxycarboxylic acids containing a secondary hydroxyl group.

21. The process of claim 11 wherein the polyesters and salts of said polyesters are derived from a mixture of at least one hydroxycarboxylic acid and at least one carboxylic acid having about 8 to about 20 carbon atoms, having no hydroxyl groups, and selected from the group consisting of saturated and unsaturated carboxylic acids.

22. The process of claim 11 wherein the polyesters and salts of said polyesters are derived from carboxylic acids selected from the group consisting of 12-hydroxystearic acid and a mixture of carboxylic acids substantially consisting of 12-hydroxystearic acid.

23. The process of claim 11 wherein the polyesters and salts of said polyesters have an average molecular weight of about 500 to about 4000.

24. The process of claim 11 wherein the polyesters and salts of said polyesters have an average molecular weight of about 1000 to about 2500.

25. The process of claim 11 wherein the polyester salts are alkaline earth metal salts of the polyester.

26. The process of claim 11 wherein the polyester salts are calcium salts of the polyester.

27. The process of claim 11 wherein the amount of basic salt is between about 0.5 and about 90%w and the amount of polyester and salt of said polyester is between about 0.01 and about 45%w, based on the weight of the composition.

28. A composition of matter stable above 140° C. which comprises (1) at least one hydrocarbon lubricating oil, (2) at least one basic polyvalent metal salt of a naphthenic acid, said basic salt having a basicity of between about 100 and about 1000%, and (3) at least one compound selected from the group consisting of a first polyester, a salt of said first polyester, and mixtures thereof, said first polyester being derived from at least one hydroxycarboxylic acid of the general formula HO—X—COOH, wherein X represents a bivalent saturated or unsaturated aliphatic radical containing at least 8 carbon atoms with at least 4 carbon atoms situated between the hydroxyl group and the carboxyl group, and a second polyester, a salt of said second polyester, and mixtures thereof, said second polyester being derived from a mixture of at least one hydroxycarboxylic acid of the general formula HO—X—COOH and at least one carboxylic acid containing no hydroxyl groups.

* * * * *